United States Patent [19]

Griffin

[11] Patent Number: 4,477,935

[45] Date of Patent: Oct. 23, 1984

[54] MATTRESS SUPPORT SYSTEM

[76] Inventor: Gordon D. Griffin, 4594 Victoria Cir., Provo, Utah 84601

[21] Appl. No.: 338,040

[22] Filed: Jan. 8, 1982

[51] Int. Cl.[3] ..... A47C 23/06

[52] U.S. Cl. ..... 5/241; 5/191; 5/236 R; 5/239

[58] Field of Search ..... 5/191, 236 R, 236 B, 5/239–241, 244, 247, 449, 455

[56] References Cited

U.S. PATENT DOCUMENTS

| | | | |
|---|---|---|---|
| 201,728 | 3/1878 | White | 5/455 |
| 2,001,252 | 5/1935 | Johnson | 5/236 B |
| 2,225,858 | 12/1940 | Church | 5/239 |
| 2,491,557 | 12/1949 | Goolsbee | 5/236 |
| 2,634,799 | 4/1953 | Young | 5/455 |
| 2,672,183 | 3/1954 | Forsyth | 5/455 |
| 4,100,631 | 7/1978 | Slone | 5/239 |
| 4,181,991 | 1/1980 | Morgan | 5/239 |

FOREIGN PATENT DOCUMENTS

| | | | |
|---|---|---|---|
| 2621803 | 6/1977 | Fed. Rep. of Germany | 5/236 R |
| 2407692 | 7/1979 | France | 5/236 R |

*Primary Examiner*—Alexander Grosz
*Assistant Examiner*—Michael F. Trettel
*Attorney, Agent, or Firm*—B. Deon Criddle

[57] ABSTRACT

A mattress support system including a support frame, tubular air springs and mattress support slats extending between pockets formed at a top surface of sleeves surrounding bladders of the tubular support springs.

4 Claims, 3 Drawing Figures

MATTRESS SUPPORT SYSTEM

BRIEF DESCRIPTION OF THE INVENTION

Prior Art

The need for comfortable sleeping systems has been long recognized. As a result a great many systems have been proposed. Presently, a most preferred system includes a support frame, a box spring assembly on the support frame and a mattress on the box spring assembly.

Water filled mattresses are becoming more and more popular, largely because the costs of such mattresses have become more favorable and because they give support to all portions of the body while conforming to the body shape.

Air filled mattresses have also been proposed. Some of these are divided to permit different sides to be pressurized to different levels, thereby providing desired individual comfort to persons resting or sleeping on the mattress.

Objects of the Invention

Principal objects of the present invention are to provide a mattress support system that is economical to produce while still providing comfortable and adequate support for persons using the system.

Other objects are to provide a sleep system that can be easily set up for use even by unskilled persons that takes up little storage space and that can be used with different kinds of mattresses as selected by the user.

Features of the Invention

Principal features of the invention include a support frame to receive and position a plurality of tubular air springs. Each air spring includes an air impervious bladder and a surrounding fabric sleeve. Pockets in the surrounding sleeves receive and hold the ends of support slats on which a mattress is to be supported.

Other objects and features of the invention will become apparent from the following detailed description and drawings, disclosing what is presently contemplated as being the best mode of the invention.

THE DRAWING

In the drawing:

FIG. 1 is a top elevation view of the mattress support system of the invention;

FIG. 2, a perspective view of an air spring of the system; and

FIG. 3, an enlarged vertical section taken on the line 3—3 of FIG. 2 and with slats shown fragmentarily.

DETAILED DESCRIPTION

Figure 1:
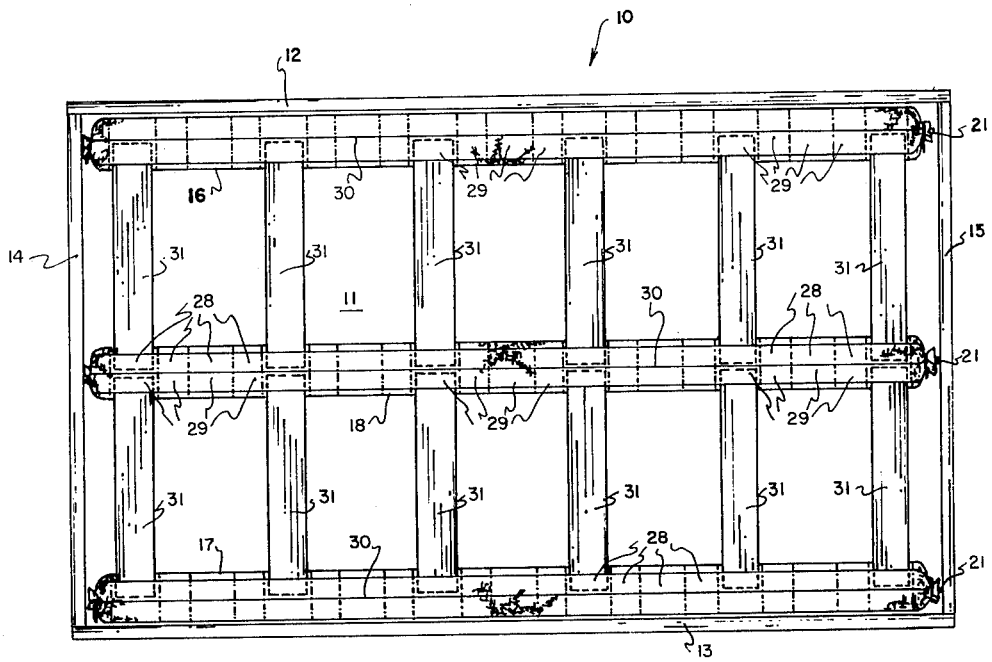

Referring now to the drawing:

In the illustrated preferred embodiment, the mattress support system of the present invention, shown generally at 10 includes a bottom 11 with upstandin side and end edges 12, 13, and 14 and 15 respectively forming a border around the bottom 11.

Three air springs 16, 17 and 18 are spaced apart, rest on the bottom 11, and are within the border formed by edges and ends 12, 13, 14 and 15. The air springs 16 and 17 are at opposite sides of the bottom 11 and are respectively adjacent to the side edges 12 and 13. The air spring 18 is centrally positioned between the air springs 16 and 17 and the springs extend between the ends 14 and 15.

The air springs are illustrated as being of similar construction, although it will be apparent that the side springs 16 and 17 could be made differently than the center spring 18.

Figure 2:
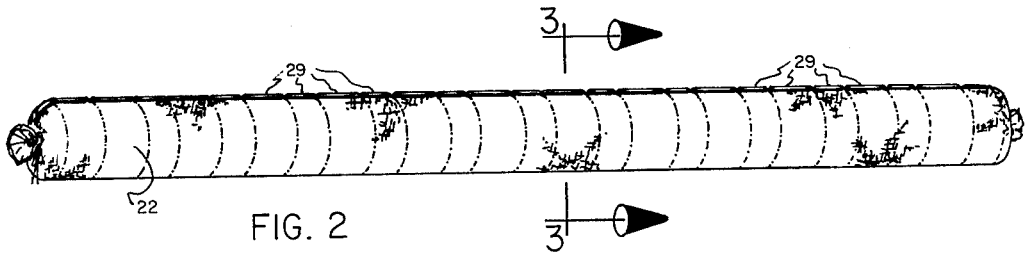
Figure 3:
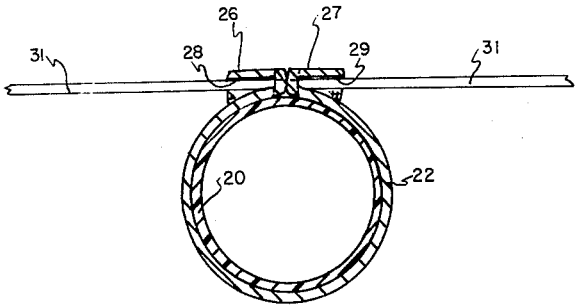

As shown best in FIGS. 2 and 3, each air spring includes an elongate bladder 20 made of plastic, neoprene rubber or other material capable of being inflated and with an air inflation stem 21 projecting from one end thereof.

A fabric sleeve 22 telescopes over the bladder 20 and is tied at both ends as shown at 23 and 25. Each fabric sleeve is sewn as shown at 25 to form pockets by sewing turned back ends of the fabric. The ends 26 and 27 are turned back in opposite directions to form pockets 28 and 29 respectively, opening in opposite directions from a common centerline 30 running the length of the springs.

As shown best in FIGS. 1 and 3, ends of wooden slats 31 are inserted into the pockets 28 and 29 of the air spring 18 with the other ends of the slats in the pockets 28 of the air spring 18 then extending into pockets 29 of the air spring 16. Similarly, the other ends of slats 31 extending into the pockets 29 of air spring 18 extend into pockets 28 of the air spring 17. While only six spaced apart slats 31 are shown interconnecting adjacent air springs, it will be apparent that more slats could be provided extending between the pockets of adjacent air springs.

Any desired mattress, such as an innerspring mattress or a resilient foam mattress can be placed over the slats 31 to complete a bed. The air springs can be inflated to give any desired degree of support for users.

While a single pair of air springs can be used, with slats extending between them for either a single or double bed, the arrangement shown is preferred for a double bed so that movement of either person on the bed will provide minimal disturbance to the other person on the bed.

Although a preferred embodiment of my invention is herein described, it is to be understood that the present disclosure is by way of example and that variations are possible without departing from the subject matter coming within the scope of the following claims, which subject matter I regard as my invention.

I claim:

1. A mattress support system comprising a plurality of spaced apart, parallel elongate air springs, each of said air springs including an elongate air filled, air impervious bladder, a fabric sleeve surrounding said bladder and having multiple pockets extending over a longitudinal centerline at the outer surface of the sleeve, said pockets comprising means on the air spring for receiving and supporting ends of said slats; and a plurality of slats extending between adjacent ones of the elongate air springs with each end of each slat extending into a pocket.

2. A mattress support system as in claim 1 including a pair of spaced apart, elongate air springs.

3. A mattress support system as in claim 1, including at least three spaced apart, elongate air springs.

4. A mattress support system as in claim 1, further including a frame comprising a flat bottom in which the air springs are rested and edges and ends surrounding the bottom and the air springs.

* * * * *